US006213349B1

(12) United States Patent
Yan

(10) Patent No.: US 6,213,349 B1
(45) Date of Patent: Apr. 10, 2001

(54) CAP STRUCTURE OF A GLUE CONTAINER

(76) Inventor: Yi-Tsung Yan, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 09/378,845

(22) Filed: Aug. 23, 1999

(51) Int. Cl.[7] ..... B67D 5/00
(52) U.S. Cl. ..... 222/83; 222/567
(58) Field of Search ..... 222/81, 83, 567, 222/108, 151, 920, 148, 541.2, 546, 542

(56) References Cited

U.S. PATENT DOCUMENTS 3,314,429 * 4/1967 Boehm et al. ..... 222/83
4,456,150 * 6/1984 Yang ..... 222/83
5,156,303 * 10/1992 Yamamoto et al. ..... 222/81
5,480,064 * 1/1996 Yan ..... 222/83

* cited by examiner

*Primary Examiner*—Philippe Derakshani

(57) ABSTRACT

An improved cap structure of a glue container, which has an injection tube extended out of the center of a threaded portion of the container; the injection tube includes a cylindrical surface for mounting dispensing tip and a tapered cylindrical surface; a guide shoulder is furnished between the cylindrical surface and the tapered cylindrical surface; one end of the tapered cylindrical surface can be stabbed through with a needle; the tapered cylindrical surface can be cut off from the guide shoulder with knife so as to facilitate mounting a dispensing tip having a needle pipe.

2 Claims, 6 Drawing Sheets

CAP STRUCTURE OF A GLUE CONTAINER

BACKGROUND OF THE INVENTION

1. Field of the Invention

This invention relates to a cap of glue container, and particularly to an injection tube of the container cap, which can be used generally, or mounted with a dispensing tip to dispense glue.

2. Description of the Prior Art

In the conventional glue, Alkyl-2-cyanoacrylat which is usually referred as instant glue or three-second glue, the cyanoacrylat can quickly be polymerized at room temperature without adding catalyst. Such quick polymerization is caused by a weak-base substance to make an anionic polymerization. Since such glue has a strong gluing force, it is subject to causing a preservation and storage problem in a container after each use.

The conventional container for a glue of cyanoacrylat is usually made of a high-density polyethylene; as shown in FIG. 1, the threaded cap 41 of the container has an injection tube 42 extended out of the cap; the injection tube 42 includes an elongate cylindrical surface 43 and a tapered cylindrical surface 45. The elongate cylindrical surface enables the tapered cylindrical surface to extend out at a given length to facilitate dispensing glue. The outer end of the elongate cylindrical surface of the injection tube is furnished with several fastening rings to facilitate a protection cap 46 to mount thereon. The tail end of the injection tube 42 on the front end of the container 40 is sealed before use. When in real use, the center of the injection tube 42 must be stabbed through with a needle to provide a small hole so as to let the glue flow out. As soon as the injection tube 42 is stabbed to have a small hole, the small hole is subject to being closed as a result of the hardening effect of glue; then, the small hole will be unable to stab through with a needle; however, the injection tube 42 can be opened by cutting a portion of the tapered cylindrical surface 45 by means of a knife; in that case, the small hole in the tapered cylindrical surface 45 will be a larger hole; then, the moisture in the air will react with the glue, i.e., the glue in the container will soon become hardened and useless.

The injection tube 42 on the front end of the conventional container for cyanoacrylat glue is usually furnished with an elongate and tapered cylindrical surface; if the glue can be used up within a short time, the elongate and tapered cylindrical surface can directly be used as an injection tube 42; otherwise, the glue can not be conserved for a longer time aside from the tail end of the injection tube being closed and unable to use next time.

SUMMARY OF THE INVENTION

The prime feature of the present invention is that the outer end of the injection tube on the container cap is furnished with an elongate and tapered cylindrical surface. The inner part thereof is furnished with a cylindrical surface for mounting a dispensing tip; between the two cylindrical surfaces, there is s guide shoulder. The elongate and tapered cylindrical surface on the front end of the injection tube can be stabbed through with a needle. The cylindrical surface on the inner part of the injection tube can be cut off with a knife from the guide shoulder, and then a dispensing tip having different diameter can be mounted on the cylindrical surface.

Another feature of the present invention is that the top center of the elongate and tapered cylindrical surface of the injection tube has a recess spot, which can easily be located and stabbed with a needle point to open the sealed end of the injection tube.

Still another feature of the present invention is that the injection tube of the container cap has two different cylindrical surfaces; when the container is filled with glue, a single container cap may be used to close the container. As soon as a user purchases the glue, the user can select an injection tube with a cylindrical surface to fit the usage desired.

A further feature of the present invention is that, after the sealed end of the tapered cylindrical surface of the injection tube is stabbed through for first use, the sealed end might be closed and unable to stab through next time; in that case, the elongate and tapered cylindrical surface can be cut off, and a dispensing tip may be mounted thereon for further use.

A still further feature of the present invention is that the inner part of the injection tube on the container cap is furnished with a cylindrical surface for mounting the dispensing tip; the cylindrical surface may be cut off with a knife from the guide shoulder; then, the cylindrical surface left can be mounted with a dispensing tip having different diameter.

DETAILED DESCRIPTION OF THE PREFERRED EMBODIMENT

Figure 1:
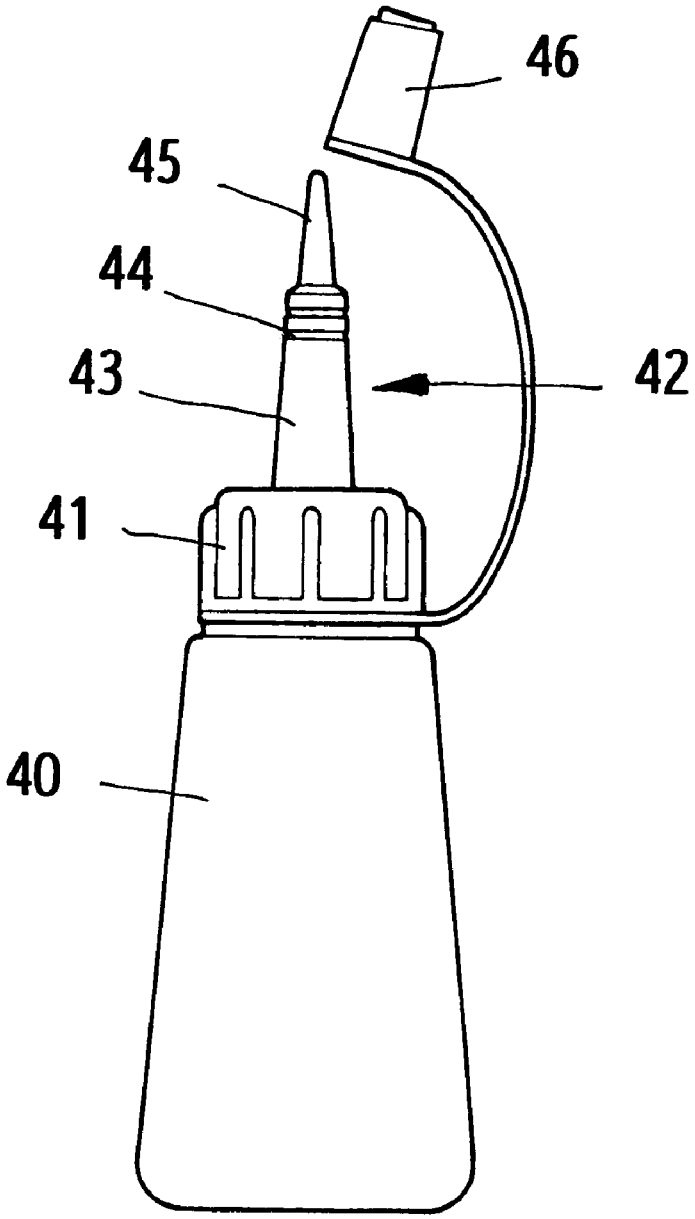
Prior Art FIG. 1
FIG. 1 is a perspective view of a conventional glue container and the threaded cap thereof.
Figure 2:
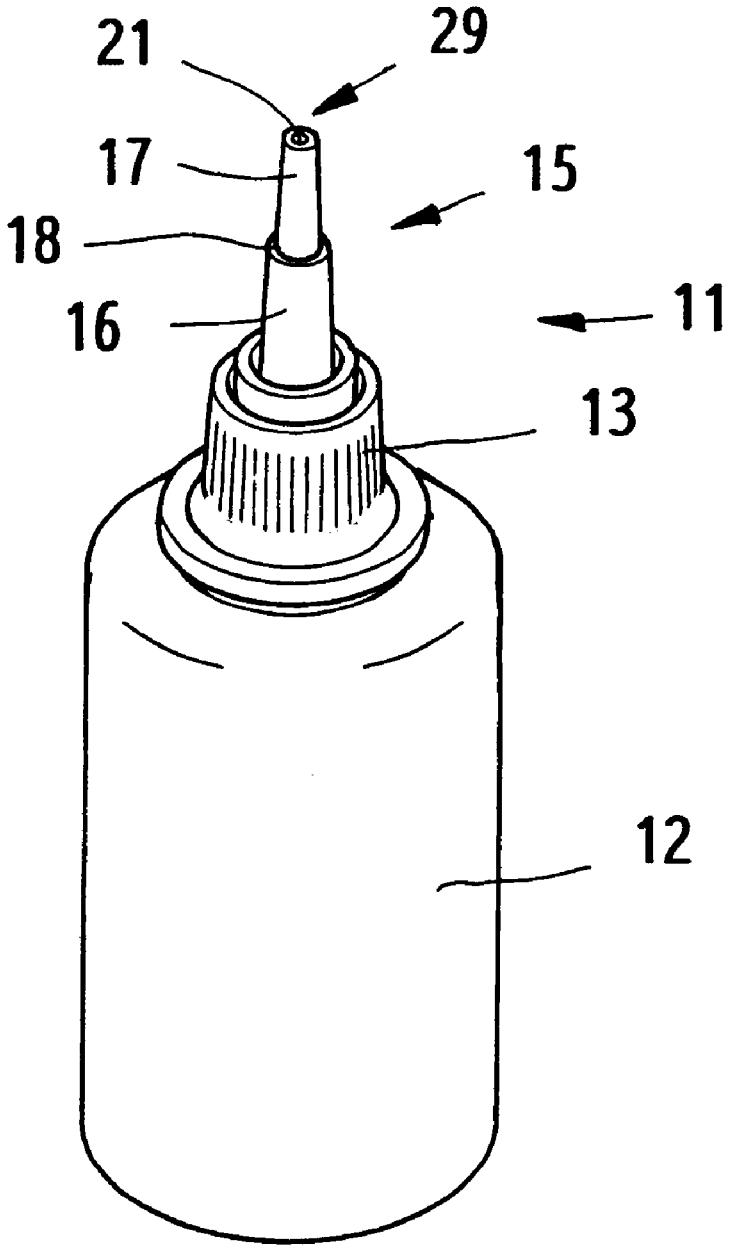
FIG. 2 is a perspective view of the present invention, showing the structure and shape of the container cap thereof.
Figure 3:
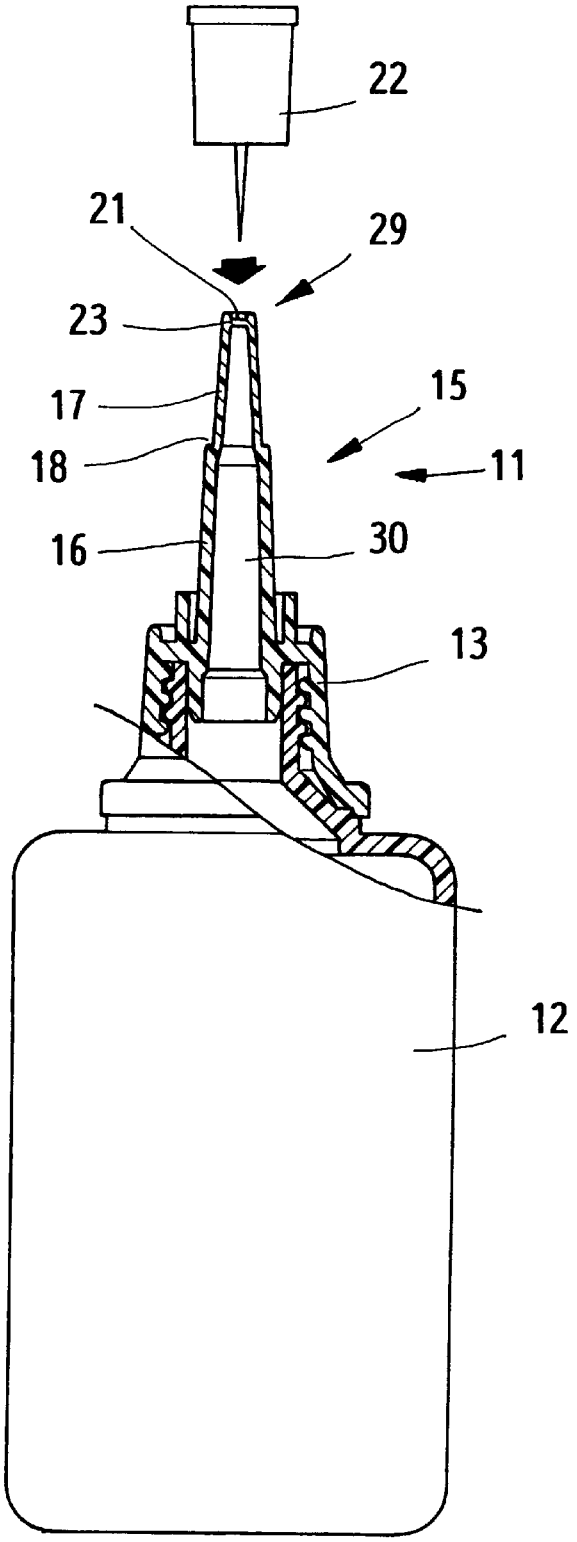
FIG. 3 is a sectional view of the present invention, showing the inner structure of the container cap.
Figure 4:
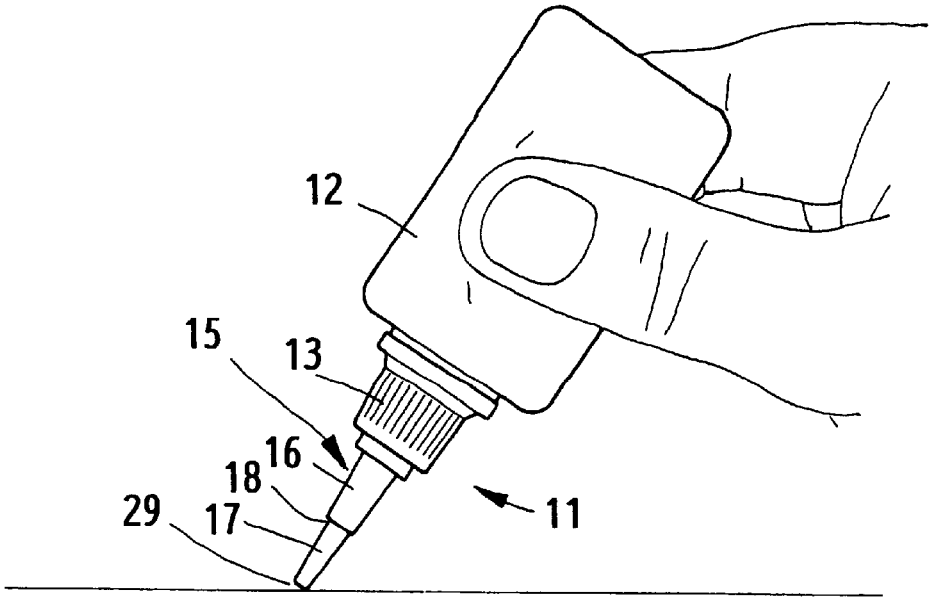
FIG. 4 is a perspective view of the present invention, showing glue being dispensed by using the tapered cylindrical surface thereof.
Figure 5:
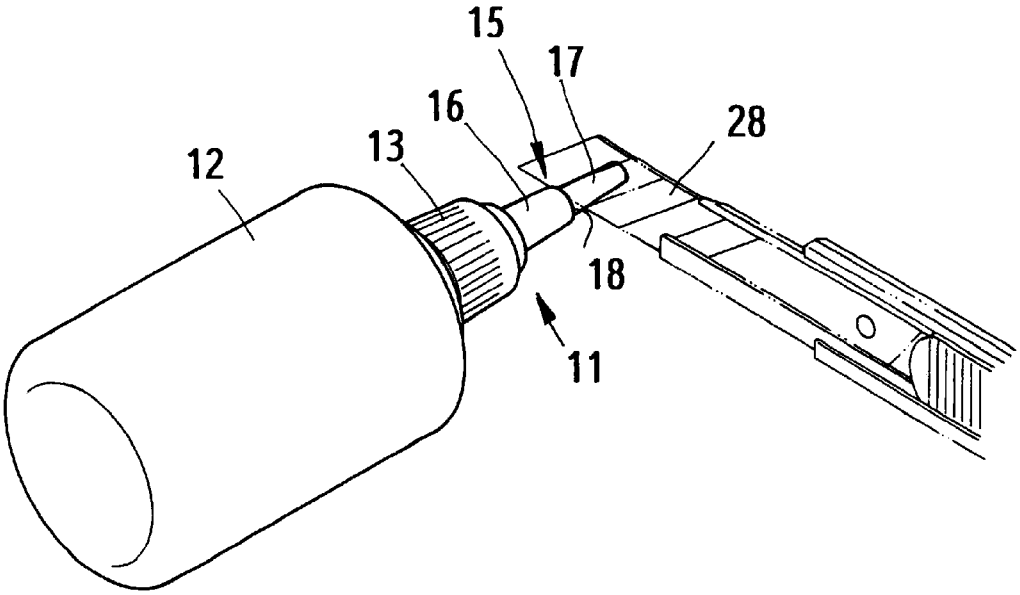
FIG. 5 is a perspective view of the present invention, showing the slender and tapered cylindrical surface to be cut off by means of knife.
Figure 6:
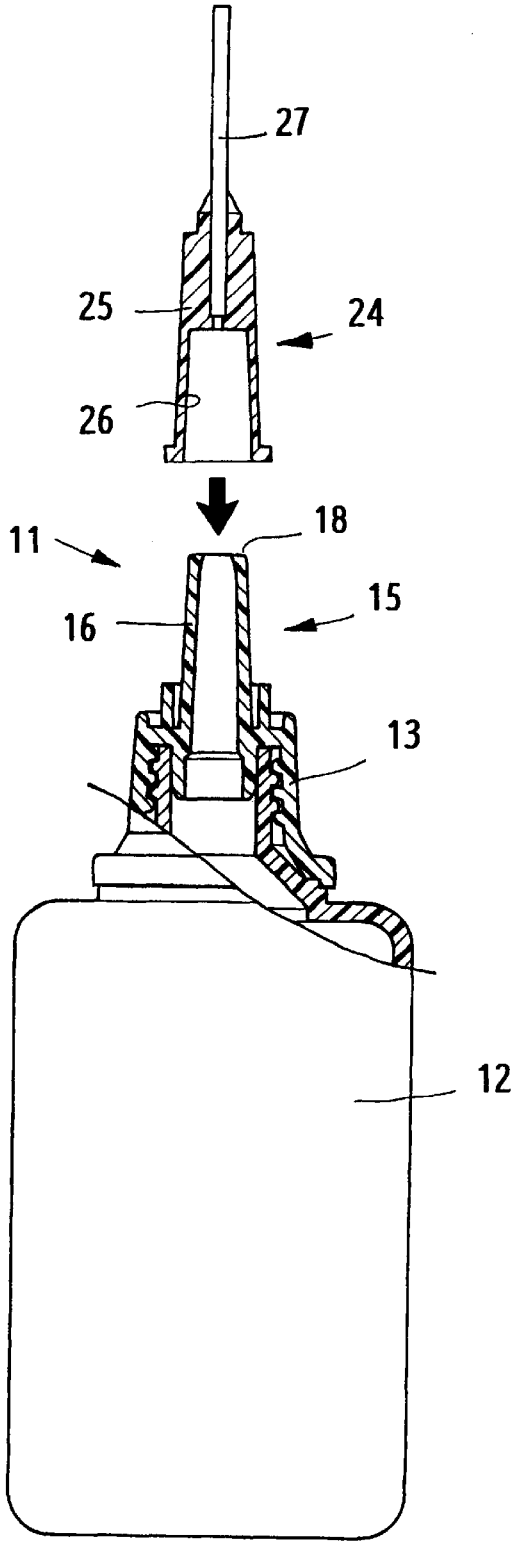
FIG. 6 is a sectional view of the present invention, showing the connection between the dispensing tip and injection tube of the container cap.
Figure 7:
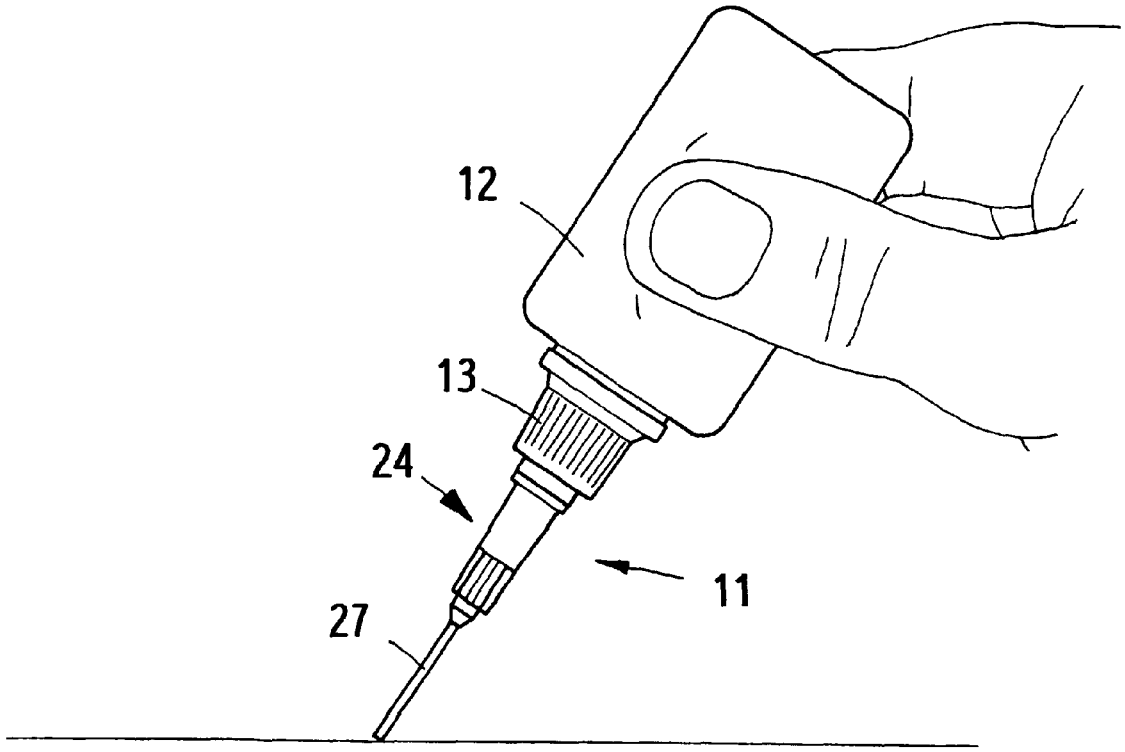
FIG. 7 is a perspective view of the present invention, showing the dispensing tip to dispense glue.

Referring to FIGS. 2 to 4, the container cap 11 of a glue container comprises a bottle mouth of a container 12 to be connected together with the container cap 11 having a threaded portion 13; the center of the threaded portion 13 has an elongate injection tube 15 extended out. The injection tube 15 has an injection mouth 29, of which the center has a recess spot 21 to be stabbed through with a needle 22 upon using the glue, and then the glue can flow out of the glue passage upon squeezing the container slightly.

The injection tube 15 of the container cap 11 includes a cylindrical surface 16 mounted with a dispensing tip and a slender cylindrical surface 17. There is a given thickness between the two cylindrical surfaces 16 and 17 and the inner passage 30 thereof so as to facilitate the glue to flow to the injection mouth 29. The tapered cylindrical surface 17 of the injection tube 15 has an injection mouth 29 with a recess spot 21 in the center thereof. The recess spot 21 has a sealed end 23 with a given thickness for sealing the inner passage 30. The tapered cylindrical surface 17 on the front end of the injection tube 15 extends outwards from the cylindrical surface 16 to be mounted with a dispensing tip 24; from the injection mouth 29 to the threaded portion 13, there is a suitable distance to facilitate glue-dispensing operation.

Before dispensing the glue, use a needle 22 to stab through the recess spot 21 of the tapered cylindrical surface 17 of the injection tube 15 so as to form into a fine through hole. When squeezing the container 12, the glue therein will flow out through the inner passage 30 of the injection tube 15 so as to provide a gluing operation as required. After gluing operation, the point of the needle 22 should be plugged into the through hole of the recess point 22 to prevent moisture from entering the container 12 so as to conserve the glue therein for a short period of time.

After the glue around the needle 22 becomes hardened, the needle 22 in the injection mouth 29 will be unable to pull out; if a user is trying to pull the needle 22 out by swinging the needle, the hole stabbed will become larger; in that case, a higher volume of glue will flow out on next time dispensing; then, the through hole will be unable to close with the needle 22, and a great amount of moisture will enter the container 12 to shorten the conservation time of the glue; since the through hole of the injection mouth becomes larger the larger, the glue left will eventually become stale and useless. The glue left may be used later only by cutting a part of the tapered cylindrical surface 17 and being sealed with a dispensing tip 24.

Since the tapered cylindrical surface 17 on the injection tube 15 of the container cap 11 is designed to provide a greater amount of glue to flow, the glue therein can be used up within a short time without requiring a user to control the flow of glue.

The injection mouth 29 on the tapered cylindrical surface 17 of the injection tube 15 is designed to be used widely; the lower part of the injection tube 15 has a cylindrical surface 16 for mounting the dispensing tip; the tapered cylindrical surface 17 may be cut off with a knife so as to facilitate the dispensing tip 24 to mount and connect directly; the dispensing tip is used for controlling the flow of glue easily as mentioned in applicant's previous application, "Dispensing Syringe for a Fluid Glue" (U.S. Pat. No. 5,480,064, Issue Jan. 2, 1996), which enables the glue in the container 12 to be conserved for a longer time.

The cylindrical surface 16 of the injection tube 15 is designed to fit the tapered degree of the mounting cylinder 26 of the dispensing tip 24; after the aforesaid parts are connected and pressed together, they can be disassembled from each other by un-screwing so as to facilitate later replacement.

The two cylindrical surfaces 16 and 17 of the injection tube 15 on the container cap 15 are molded integrally into one piece. The cylindrical surface 16 is set at the inner section of the injection tube 15, while the tapered cylindrical surface 17 is set at the outer section of the injection tube 15; a guide shoulder 18 is furnished between the cylindrical surface 16 and the tapered cylindrical surface 17 so as to separate the two cylindrical surfaces 16 and 17 from each other. The guide shoulder 18 can also provide a guide function for a knife which is used to cut off the tapered cylindrical surface 17; then, a dispensing tip 24 can easily be mounted on the flat end of the cylindrical surface 16.

If a larger amount of glue is required to dispense, the output amount of glue may not be controlled accurately. As shown in FIGS. 3 and 4, the injection tube 15 can be opened by means of a needle 22 to stab through the recess spot 21 of the tapered cylindrical surface 17, and to reach the front end of the passage 30; as soon as the needle 22 is pulled out, a through hole will be furnished. Squeeze the container 12 slightly to have the glue flowed out of the injection mouth 29 with a suitable amount. When not in use, plug the needle 22 back into the through hole of the tapered cylindrical surface 17 so as to prevent the glue from leaking out.

When using the glue, a correct dispensing tip 24 should be used; as shown in FIG. 3, 5 to 7, use a knife 28 to cut a part nearing the guide shoulder 18 between the cylindrical surface 16 and the tapered cylindrical surface 17 in order to have the end of the cylindrical surface 16 cut into a flat surface; select a dispensing tip 24 having a needle pipe 27 with a suitable diameter, and mount the dispensing tip 24 to the injection tube 15 closely; then, the dispensing operation is ready to start. In case of the dispensing tip being damaged or un-serviceable, it should be removed by turning the needle base 25, and replace it with a new one; the dispensing tip 24 may also be removed upon the glue in the container 12 being used up, and then it can be mounted on a new container cap 11 for further use.

According to the method and technique of the present invention, the injection tube 15 of the container cap 11 is furnished with a cylindrical surface 16 for mounting a dispensing tip, and a tapered cylindrical surface 17. A guide shoulder 18 is furnished between the two cylindrical surfaces 16 and 17. The container cap 11 has a function for mounting a general injection tube 15 to be opened by stabbing, and also has a cylindrical surface 16 to connect with a dispensing tip. To cut the tapered cylindrical surface 17, the edge of a knife should be put on the guide shoulder 18 symmetrically in order to have the end of the cylindrical surface 16 cut into a flat surface to facilitate mounting the dispensing tip 24 in place.

According to the aforesaid description of the embodiments, the structure and features of the container cap 11 have been disclosed fully; it is deemed that the present invention has provided an improvement and novelty in the field to fulfil objects as expected, and such improvement and novelty are never anticipated and accomplished by any person in the field of the kind.

What is claimed is:

1. A cap structure of a glue container to be screwed to one end of a glue container, and having features as follows:

center of a threaded portion of said container cap having an injection tube extended out of said center; said injection tube including a cylindrical surface for mounting a dispensing tip and a tapered cylindrical surface; a guide shoulder furnished between said cylindrical surface and said tapered cylindrical surface; said tapered cylindrical surface having a sealed end which can be stabbed through with a needle; said dispensing tip to be mounted on said cylindrical surface; a knife used to cut off said tapered cylindrical surface from said guide shoulder so as to facilitate mounting said dispensing tip on said cylindrical surface.

2. A cap structure of a glue container as claimed in claim 1, wherein end center of said tapered cylindrical surface has a recess spot; and a sealed end furnished between said recess spot and an inner passage.

* * * * *